US005595068A

United States Patent [19]

Amr

[11] Patent Number: 5,595,068

[45] Date of Patent: Jan. 21, 1997

[54] CEILING MOUNTED INDOOR UNIT FOR AN AIR CONDITIONING SYSTEM

[75] Inventor: Yehia M. Amr, Manlius, N.Y.

[73] Assignee: Carrier Corporation, Syracuse, N.Y.

[21] Appl. No.: 572,808

[22] Filed: Dec. 15, 1995

[51] Int. Cl.[6] ..... F25D 17/04; F25D 23/12; F24F 13/068

[52] U.S. Cl. ..... 62/418; 62/259.1; 454/296

[58] Field of Search ..... 62/407, 404, 426, 62/427, 218, 296, 259.1, 417; 454/906, 296

[56] References Cited

U.S. PATENT DOCUMENTS

| | | | |
|---|---|---|---|
| 2,973,703 | 3/1961 | Jack | 454/296 |
| 3,263,438 | 8/1966 | Maudlin | 62/259.2 |
| 3,929,285 | 12/1975 | Daugherty, Jr. | 236/13 |
| 4,076,073 | 2/1978 | Yamamoto et al. | 165/53 |
| 4,090,434 | 5/1978 | Krisko et al. | 454/264 |
| 5,495,724 | 3/1996 | Koster | 62/259.1 |

*Primary Examiner*—William Doerrler

[57] ABSTRACT

A ceiling mounted indoor unit (10) for an air conditioning system of the type that is generally recessed within a false or drop ceiling. The air conditioner has a fan (11) and heat exchanger (12) mounted within an enclosure (20). There is a primary fan suction inlet (31) and a fan discharge outlet (32) in the bottom wall (21) of the enclosure, and an auxiliary fan suction inlet (33) in a side wall (22) of the enclosure, so that at least some of the air entering the enclosure and passing through the heat exchanger will be drawn from the space between the false ceiling and the true ceiling. Air reenters the interceiling space through holes and gaps in the false ceiling. The auxiliary fan suction inlet reduces radiated noise and improves air flow distribution in the room served by the air conditioner.

5 Claims, 1 Drawing Sheet

CEILING MOUNTED INDOOR UNIT FOR AN AIR CONDITIONING SYSTEM

BACKGROUND OF THE INVENTION

This invention relates generally to air conditioning systems. More particularly the invention relates to an improved ceiling mounted indoor unit of an air conditioning system.

Ductless split air conditioning systems are usually found in residential and small commercial applications. Unlike a ducted split system, in which there is a central indoor unit with conditioned air being distributed to rooms by ducting, a ductless split system has one or more indoor units located in the room(s) served by the system. The term "split" refers to the configuration of the entire system as being split into indoor and outdoor units. Both a ducted and a ductless split system provide one heat exchanger in an outdoor unit located external to the space to be conditioned, while another heat exchanger is located in an indoor unit. In a ductless split system refrigerant lines running between the indoor and outdoor units interconnect the two heat exchangers and the compressor. There are usually fans associated with both the indoor and outdoor heat exchangers.

It is common to mount the indoor unit of a ductless split air conditioner at a high position in the room it is to serve. The indoor unit may be mounted on a wall or hung from the ceiling. If the room has a false ceiling, the indoor unit may be recessed into the false ceiling so as to make it as unobtrusive as possible. False ceilings are usually constructed of a relatively porous material which is sound absorbent.

An important objective in the design of an air conditioning system is low radiated noise levels. The primary source of noise in an indoor unit is the fan, with the noise being radiated primarily from the air discharge opening but also from the air inlet opening.

Another important design objective is that there be good air flow distribution within the room to be conditioned. Because warm air rises, it may collect and become stratified at or near the ceiling level in a room. This is undesirable in either the heating or cooling modes of operation. A recessed ceiling mounted indoor unit will not normally recirculate this stratified air unless it has inlet louvers that project outwardly and downwardly from the main portion of the unit, and such louvers tend to detract from the appearance of the unit.

In a typical indoor unit, the air suction inlet and air discharge outlet are located relatively close to each other. In such a unit, there can be a significant proportion of the total air flow through the unit that "short circuits" from discharge to suction thus reducing the amount of air recirculated through the entire volume of the room served.

SUMMARY OF THE INVENTION

The present invention is an improved ceiling mounted indoor unit for an air conditioner. In addition to a fan suction inlet on the bottom of the enclosure of the unit, there are also auxiliary fan suction inlets located on the side of the unit. When the unit is mounted so that it is recessed into a false ceiling, the auxiliary fan suction inlets are positioned so that the fan can draw air from the space between the false and true ceilings. In doing so, a vacuum is created in that space, and that vacuum will draw the warm air trapped just below the false ceiling through the porous false ceiling, thereby reducing or eliminating stratification and improving overall air circulation in the room that the unit serves.

The auxiliary fan suction inlets also allow the fan to operate more quietly because inlet losses are reduced. That is, with the increased area of the inlet openings, the velocity of the inlet air is reduced and the inlet losses are accordingly reduced (i.e. losses are proportional to velocity$^2$). With these reduced losses, the fan can then be operated at lower speeds, which, in turn, will cause less noise to be produced and emitted. Furthermore, at least a portion of the noise that the fan produces can radiate through the auxiliary fan suction inlets and into the space between the false and true ceilings, where it can be absorbed by the sound absorbent material in the false ceiling.

With the use of the auxiliary air inlet openings, the amount of air flowing into the primary inlet opening will be reduced. Both this, and the above described flow of the stratified air through the false ceiling to improve the air flow distribution, will tend to reduce the amount of air flow that is "short circuited" from the discharge opening to the inlet opening.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Figure 1:
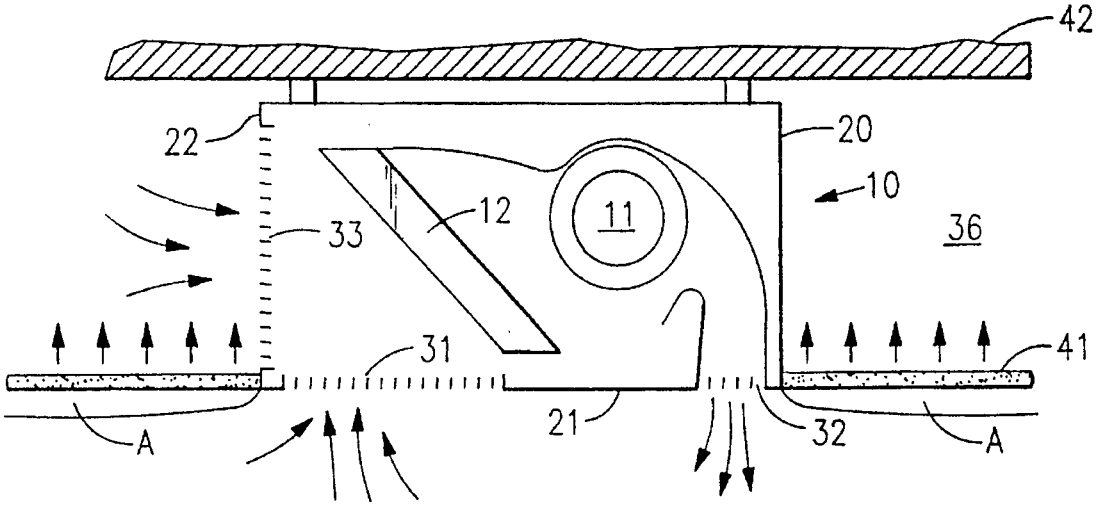
FIG. 1 is a schematic view of the indoor unit of the present invention.
Figure 2:
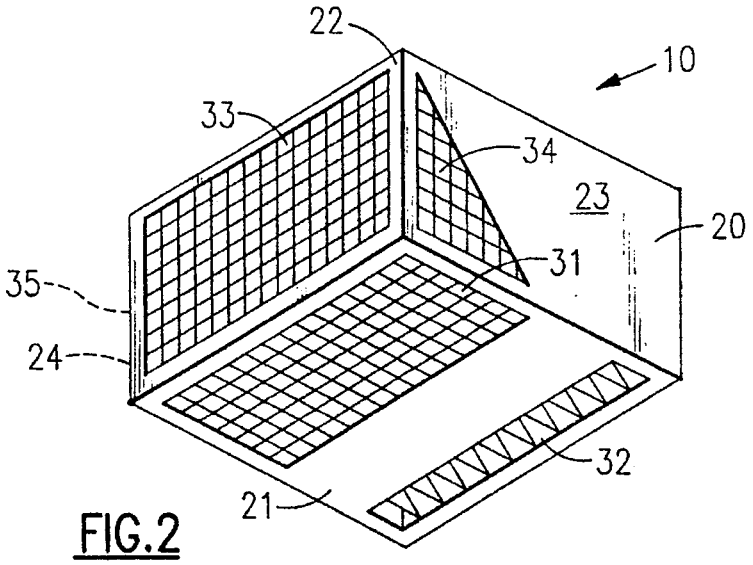
FIG. 2 is an isometric view of the indoor unit of the present invention.

FIG. 1 shows indoor unit 10 of the present invention mounted in a room by hanging from true ceiling 42 and recessed in false ceiling 41. Inside the enclosure are the fan 11 and the heat exchanger 12. In the bottom wall 21 of enclosure 20 are located a primary fan suction inlet 31 and a fan discharge outlet 32. The fan 11 draws air from the room served, through inlet 31 and through heat exchanger 12, and discharges conditioned air back to the room through outlet 32. Auxiliary fan suction inlets 33, 34 and 35 are formed in side walls 22, 23 and 24, respectively, of enclosure 20 and are in fluid flow communication with that normally dead air space 36 between the true and false ceilings. Fan 11 draws air in through those inlets 33–35 to thereby create a partial vacuum in this space 36. This, in turn, causes the stratified air "A" below the false ceiling to flow through the porous ceiling as shown by the arrows. That warm air is then eventually drawn back into the suction inlets 33–35, passed through the coil 12 where it is conditioned and then made to flow back into the room via the discharge outlet 32. FIG. 2 provides another view of the exterior of unit 10 and the locations of inlets 31, and 33–35, and outlet 32.

Because of the additional inlet area provide by inlets, 33–35, inlet flow losses are less than if just primary inlet 31 were used. This allows the fan to be run at lower speeds to obtain the same airflow volumes, thereby making less noise. Moreover, some of the sound that fan 11 produces will pass out through auxiliary inlets 33–35 into the space between true ceiling 42 and false ceiling 41, where it will be absorbed by the absorbent material in the false ceiling 41. The continued effects of these two phenomenae bring about a substantial reduction in the radiated sound levels from unit 10 as measured in the room. This noise level reduction is estimated to be as much as 3 dBA.

With the decrease in the air flow volume to the primary air inlet 31, and the improved air flow distribution caused by the flow of stratified air into the space 36, the "throw of the air from the air discharge opening 32 will be increased, and the amount of air that is "short circuited" to the inlet 31 will be favorably reduced.

The present invention is applicable not only where installed in a porous false ceiling, but in any tiled ceiling. That is, even where the tiles are not porous, the loose manner in which the tiles are normally mounted in the support structure will allow sufficient "leakage" of air flow therethrough to permit the stratified air to flow into the space 36.

The unit of the present invention may also be mounted in a room that does not have a false ceiling. This would provide some improvement in the performance characteristics discussed above, but not to the extent provided when used with a false ceiling as described.

I claim:

1. In a room air conditioning unit of the type having an air inlet opening and an air discharge opening in the bottom surface thereof, and a heat exchanger coil and a fan disposed within the unit in serial flow relationship between the inlet and discharge openings, the unit being adaptable for mounting in a space between a true and false ceiling, wherein the improvement comprises:

an auxiliary air inlet opening formed in one side of the unit for providing fluid flow communication between the space and the fan, such that the fan simultaneously draws air from both the room and the space by way of the heat exchanger coil.

2. The room air conditioning unit as set forth in claim 1 wherein the heat exchanger coil is disposed between said auxiliary inlet opening and the fan.

3. The room air conditioning unit as set forth in claim 1 wherein the false ceiling is porous so as to allow the flow of air therethrough, from the room to the space.

4. An improved ceiling mounted indoor unit for an air conditioning system, said indoor unit having an enclosure having a bottom wall and a side wall, a said bottom wall having a primary fan suction opening and a fan discharge opening, a fan disposed in said enclosure, and operable to cause air to flow into said primary fan suction opening and out of said fan discharge opening, a heat exchanger positioned in said enclosure so that said air flow will pass therethrough, and an auxiliary fan suction opening formed in a side wall of said enclosure, in upstream air flow relationship with said fan.

5. A method of improving the circulation of air in a room having a true ceiling and an air permeable false ceiling, with an interceiling space formed therebetween comprising the step of:

installing a ceiling mounted indoor unit of an air conditioning system that has a heat exchanger coil and a fan disposed in serial flow relationship between inlet and discharge openings and at least one air suction inlet that draws air directly from said interceiling space and to said fan by way of said heat exchanger coil to thereby create a partial vacuum which in turn, draws air from said room through said false ceiling and into said interceiling space.

* * * * *